US010952590B2

(12) United States Patent
Kim et al.

(10) Patent No.: US 10,952,590 B2
(45) Date of Patent: Mar. 23, 2021

(54) DISHWASHER

(71) Applicant: LG Electronics Inc., Seoul (KR)

(72) Inventors: Ilhwan Kim, Seoul (KR); Seunghun Kim, Seoul (KR); Sangwoo Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 92 days.

(21) Appl. No.: 16/273,666

(22) Filed: Feb. 12, 2019

(65) Prior Publication Data

US 2019/0246868 A1 Aug. 15, 2019

(30) Foreign Application Priority Data

Feb. 12, 2018 (KR) ..... 10-2018-0017205

(51) Int. Cl.
*A47L 15/42* (2006.01)
*A47L 15/00* (2006.01)
*A47L 15/23* (2006.01)

(52) U.S. Cl.
CPC ..... *A47L 15/428* (2013.01); *A47L 15/0015* (2013.01); *A47L 15/0036* (2013.01);
(Continued)

(58) Field of Classification Search
CPC ..... A47L 15/4234; A47L 15/00–508; A47L 15/428; A47L 15/4278; A47L 15/4282;
(Continued)

(56) References Cited

U.S. PATENT DOCUMENTS 3,683,944 A * 8/1972 Anderson ..... A47L 15/0002 134/57 R
5,673,714 A * 10/1997 Campagnolo ..... A47L 15/23 134/176

(Continued)

FOREIGN PATENT DOCUMENTS

CN 106510591 3/2017
CN 106725208 5/2017

(Continued)

OTHER PUBLICATIONS

PCT International Search Report in International Application No. PCT/KR2019/001667, dated Jun. 5, 2019, 3 pages.

(Continued)

*Primary Examiner* — Michael E Barr
*Assistant Examiner* — Omair Chaudhri
(74) *Attorney, Agent, or Firm* — Fish & Richardson P.C.

(57) ABSTRACT

A dishwasher includes a case, a sump connected to an inside of the case and collecting washing water, a washing pump receiving washing water from the sump and generating steam, and a steam nozzle connected to the washing pump and spraying steam to the inside of the case. The steam nozzle includes a steam nozzle body having a steam inlet and including a steam accommodating portion accommodating steam therein, a first steam sprayer provided in the steam nozzle body and spraying steam to the inside of the case, and a second steam sprayer provided in the steam nozzle body and disposed at a position farther from the steam inlet than the first steam sprayer, wherein a tunnel flow path penetrating through a lower end of the first steam sprayer is formed to allow steam passing through the tunnel flow path to be introduced into the second steam sprayer.

20 Claims, 11 Drawing Sheets

(52) U.S. Cl.
CPC ..... *A47L 15/23* (2013.01); *A47L 15/4214* (2013.01); *A47L 15/4234* (2013.01); *A47L 15/4278* (2013.01); *A47L 15/4225* (2013.01)

(58) Field of Classification Search
CPC ..... A47L 15/4214; D06F 17/04; D06F 17/12; D06F 39/008; D06F 39/08; D06F 39/083; D06F 73/00; D06F 73/02; B08B 3/00; B08B 3/02; B08B 3/024; B08B 5/00; B08B 5/02; B08B 5/023
See application file for complete search history.

(56) References Cited

U.S. PATENT DOCUMENTS

| | | | | |
|---|---|---|---|---|
| 2010/0326478 | A1 | 12/2010 | Pyo et al. | |
| 2017/0196432 | A1* | 7/2017 | Kim | A47L 15/4289 |

FOREIGN PATENT DOCUMENTS

| | | | |
|---|---|---|---|
| CN | 107260102 | A * | 10/2017 |
| CN | 206675490 | | 11/2017 |
| KR | 100857804 | | 9/2008 |
| KR | 101052779 | | 7/2011 |
| KR | 1020170016180 | | 2/2017 |
| WO | WO2017022985 | | 2/2017 |

OTHER PUBLICATIONS

Extended European Search Report in European Application No. 19156595.1, dated Aug. 2, 2019, 7 pages.

* cited by examiner

DISHWASHER

CROSS-REFERENCE TO RELATED APPLICATION

This application claims the priority benefit of Korean Patent Application No. 10-2018-0017205, filed on Feb. 12, 2018, in the Korean Intellectual Property Office, the disclosure of which is incorporated herein by reference.

TECHNICAL FIELD

The present disclosure relates to a dishwasher and, more particularly, to a dishwasher for washing dishes and cooking utensils by spraying (injecting or jetting) washing water and steam.

BACKGROUND

A dishwasher is a home appliance for removing soiling such as food waste residing on dishes or cooking utensils (hereinafter, referred to as 'cleaning target (i.e., object to be cleaned') by high-pressure washing water sprayed from a spray arm.

The dishwasher cleans a cleaning target using heated washing water or performs cleaning or sterilization by supplying steam to the cleaning target. It has been proposed to generate steam by installing a heater in a washing pump in order to efficiently generate steam. It has also been proposed to dispose a steam nozzle for spraying steam at a lower end of a door so that steam may be effectively applied to a washing object (Korean Patent Laid-Open Publication No. 10-2017-0016180).

The steam nozzle has a plurality of sprayers (spray orifices) for spraying steam into a washing chamber in which a cleaning target is accommodated. Here, the amount of steam sprayed from the plurality of sprayers (spray orifices) provided at both ends of the steam nozzle is not uniform.

SUMMARY

An aspect of the present disclosure provides a dishwasher in which steam is uniformly sprayed from a plurality of sprayers (spray orifices) provided at both ends of a steam nozzle.

Another aspect of the present disclosure provides a dishwasher in which a steam flow path in a steam nozzle is improved such that steam effectively flows to a steam sprayer (or steam spray orifice) positioned away from a portion in which steam is introduced to the steam nozzle.

Another aspect of the present disclosure provides a dishwasher in which steam spray from some of steam sprayers (spray orifices) of a steam nozzle is improved, while steam spray from the other steam sprayers is not hindered.

The problems of the present disclosure are not limited to the above-mentioned problems, and other unmentioned problems may be clearly understood by those skilled in the art from the following description.

According to the present disclosure, a dishwasher includes: a case accommodating a cleaning target; a sump connected to the inside of the case and collecting washing water; a washing pump receiving the collected washing water from the sump and generating steam; and a steam nozzle connected to the washing pump by a steam hose and spraying steam to the inside of the case.

The steam nozzle may include: a steam nozzle body having a steam inlet and including a steam accommodating portion accommodating steam therein; a first steam sprayer provided in the steam nozzle body and spraying the steam accommodated in the steam accommodating portion to the inside of the case; and a second steam sprayer provided in the steam nozzle body and disposed at a position farther from the steam inlet than the first steam sprayer.

The steam nozzle may have a tunnel flow path penetrating through a lower end of the first steam sprayer to allow steam passing through the tunnel flow path to be introduced into the second steam sprayer.

The first steam sprayer may include a first steam spray orifice having one end communicating with the tunnel flow path of the first steam sprayer and the other end opened to the inside of the case, and a portion of the steam introduced to the tunnel flow path may be sprayed to the inside of the case through the first steam spray orifice.

A sectional area of the tunnel flow path of the first steam sprayer may be greater than a sectional area of the first steam spray orifice.

A sectional area of an end portion of the tunnel flow path close to the steam inlet may be greater than a sectional area of an end portion of the tunnel flow path close to the second steam sprayer.

The steam nozzle body may include a flow path encircling the first steam sprayer.

The steam nozzle body may extend horizontally with respect to a central portion where the steam inlet is formed.

The first steam sprayer may include a pair of first steam sprayers disposed on the left and right sides of the steam inlet.

The second steam sprayer may include a pair of second steam sprayers disposed on the left and right sides of the steam inlet at positions farther from the steam inlet than the pair of first steam sprayers.

A virtual line connecting the centers of the pair of first steam sprayers and a direction in which the tunnel flow path extends may form a predetermined angle therebetween.

A width of a flow path of the steam nozzle body may be narrowed from the first steam sprayer toward the second steam sprayer.

The steam nozzle body may include a pair of coupling holes formed on both sides of the steam inlet and a flow path encircling the coupling holes.

The steam nozzle body may include at least one guide rib provided between the steam inlet and the coupling holes and guiding the steam introduced to the steam inlet to the first steam sprayer.

The steam nozzle may include an upper case coupled with the steam nozzle body to form the steam accommodating portion and including a first upper case hole allowing the first steam sprayer to be inserted therein and a second upper case hole allowing the second steam sprayer to be inserted therein.

The steam nozzle may include a lower case allowing the steam nozzle body to be seated thereon and coupled with the upper case to form an internal space accommodating the steam nozzle body.

Details of other embodiments are included in detailed descriptions and drawings.

The dishwasher according to the present disclosure has one or more of the following advantages and effects.

First, since a flow rate of steam flowing into the second steam sprayer through the tunnel flow path formed at the first steam sprayer is improved, the steam may be uniformly sprayed from the second steam sprayer, as well as from the first steam sprayer.

Second, since the sectional area of the end portion of the tunnel flow path near the steam inlet is larger than the sectional area of the end portion of the tunnel flow path near the second steam sprayer, the amount of steam sprayed from the first steam sprayer and the amount of steam introduced to the second steam sprayer through the first steam sprayer may be effectively distributed. As a result, steam spray from the second steam sprayer may be improved, while steam spray from the first steam sprayer is maintained at a predetermined level or higher.

Advantages and effects of the present disclosure are not limited to the foregoing effects and any other technical effects not mentioned herein may be easily understood by a person skilled in the art from the descriptions of claims.

BRIEF DESCRIPTION OF THE DRAWINGS

The above and other objects and features of the present disclosure will become apparent from the following description of preferred embodiments given in conjunction with the accompanying drawings, in which.

DETAILED DESCRIPTION

Figure 1:
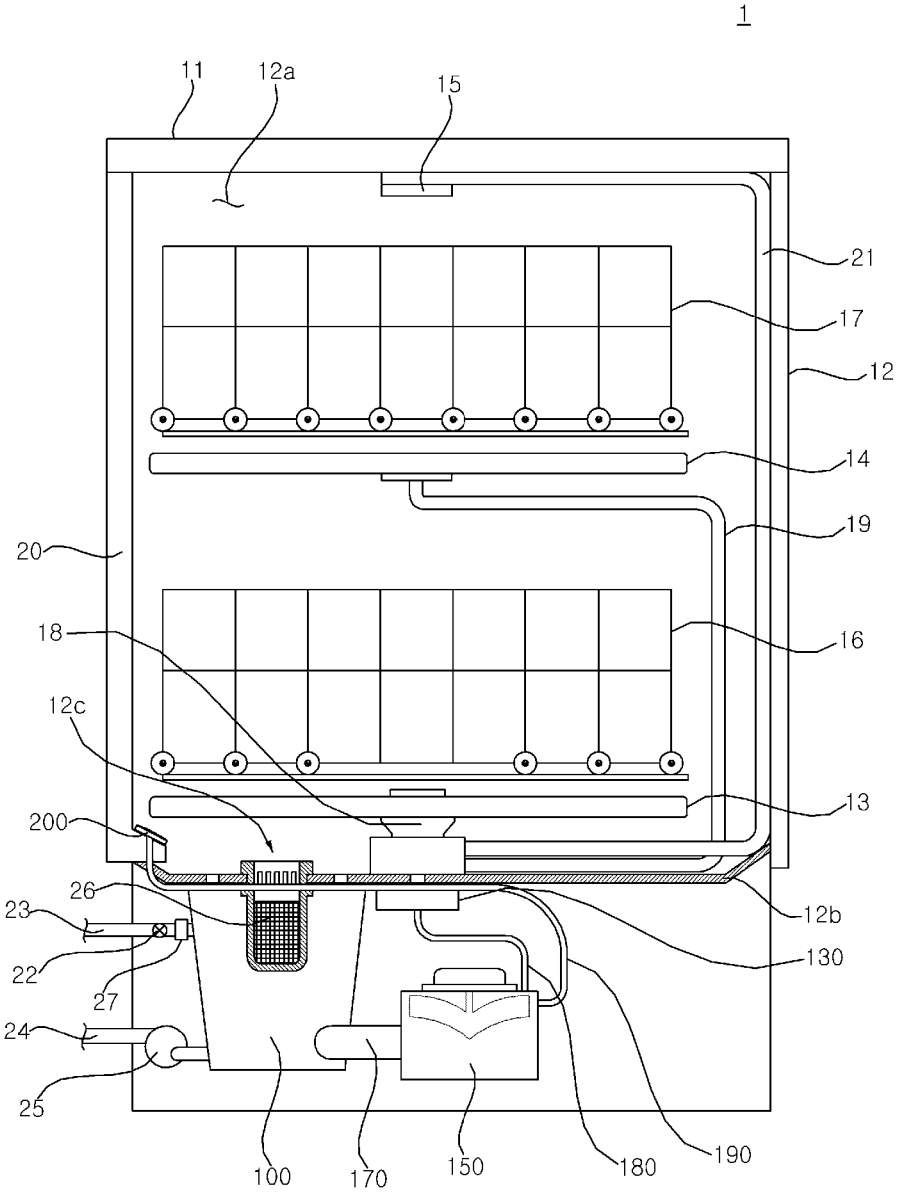
FIG. 1 is a schematic structural view of a dishwasher according to an embodiment of the present disclosure.

The advantages and features of the present disclosure and methods for achieving these will be clarified in detail through embodiments described hereinafter in conjunction with the accompanying drawings. However, embodiments of the present disclosure may, however, be implemented in many different forms and should not be construed as being limited to the embodiments set forth herein. Rather, these embodiments are provided so that this disclosure will be thorough and complete, and will fully convey the scope of the disclosure to those skilled in the art and are defined by the claim coverage of the present disclosure.

Hereinafter, a dishwasher according to embodiments of the present disclosure will be described with reference to the accompanying drawings.

Hereinafter, front (F)/rear (R)/left (Le)/right (Ri)/up (U)/down (D) may be defined as illustrated in the drawings. However, these are merely illustrative and may also be defined to be different therefrom.

FIG. 1 is a schematic structural view of a dishwasher according to an embodiment of the present disclosure.

Figure 2:
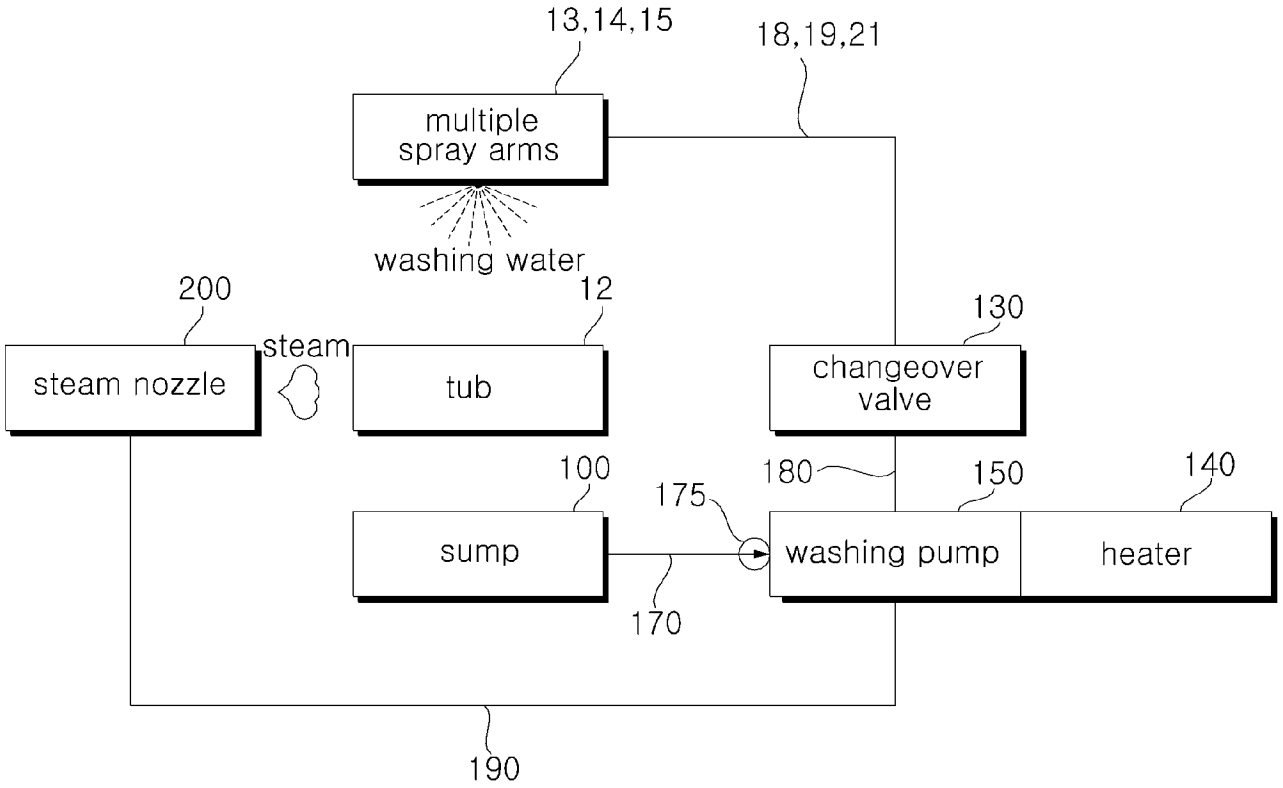
FIG. 2 is a view illustrating a configuration of a dishwasher according to an embodiment of the present disclosure.

FIG. 2 is a view illustrating a configuration of a dishwasher according to an embodiment of the present disclosure.

The dishwasher 1 according to the embodiment of the present disclosure includes a case 11 forming an outer appearance, a tub 12 provided inside the case 11 to form a washing chamber 12*a* in which an object to be cleaned (or cleaning target) is accommodated, a door 20 provided on a front surface of the tub 12 to open and close the washing chamber 12*a*, a sump 100 disposed below the tub 12 to store washing water, a plurality of spray arms 13, 14, and 15 spraying washing water into the tub 12, a washing pump 150 supplying washing water stored in the sump 100 to the plurality of spray arms 13, 14 and 15 and generating steam, a steam nozzle 200 provided at the door and spraying steam generated by the washing pump 150 to the washing chamber 12*a*, a steam hose 190 connecting the washing pump 150 and the steam nozzle 200, and a changeover valve 130 disposed at the sump 100 and distributing washing water to the plurality of spray arms 13, 14, and 15.

Inside the case 11, the tub 12 in which the dishes to be washed are accommodated may be disposed. The case 11 may accommodate the tub 12 and all of the components of the dishwasher 1.

The tub 12 has a hexahedral shape in which a front side is open to form a washing chamber 12*a* therein. A communication hole 12*c* through which the washing water flows into the sump 100 is formed on the bottom 12*b* of the tub 12. The washing chamber 12*a* includes a plurality of racks 16, 17 for receiving the cleaning target. The plurality of racks 16 and 17 includes a lower rack 16 disposed at a lower portion of the washing chamber 12*a* and an upper rack 17 disposed at an upper portion thereof. The lower rack 16 and the upper rack 17 may be disposed to be spaced apart from each other vertically and slidably drawn out forwards from the tub 12.

The plurality of spray arms 13, 14, and 15 are arranged in a vertical direction. The plurality of spray arms 13, 14, and 15 includes a low spray arm 13 disposed at a lowermost end and spraying washing water upwards toward the lower rack 16, an upper spray arm 14 disposed above the low spray arm 13 and spraying washing water upwards toward the upper rack 17, and a top spray arm 15 disposed at an upper end of the washing chamber 12*a*, which is above the upper spray arm 14, and spraying washing water downwards.

The plurality of spray arms 13, 14, and 15 are supplied with washing water from the washing pump 150 through a plurality of spray arm connecting flow paths 18, 19, and 21. The plurality of spray arm connecting flow paths 18, 19, and 21 include a low spray arm connecting flow path 18 connected to the low spray arm 13, an upper spray arm connecting flow path 19 connected to the upper spray arm 14, and a top spray arm connecting flow path 21 connected to the top spray arm 15.

The sump 100 is disposed below the bottom 12*b* of the tub 12 to collect washing water. The sump 100 is connected to a water supply flow path 23 through which washing water supplied from an external water source flows. The water supply flow path 23 includes a water supply valve 22 for controlling washing water supplied from an external water source. When the water supply valve 22 is opened, the washing water supplied from the external water source flows into the sump 100 through the water supply flow path 23. The water supply flow path 23 includes a flow meter 27 for measuring a flow rate of the washing water flowing into the sump 100 through the water supply flow path 23.

The sump 100 is connected to a drainage flow path 24 for guiding the stored washing water to the outside of the dishwasher 1. The drainage flow path 24 includes a drain pump 25 for draining the washing water in the sump 100 through the drainage flow path 24. When the drain pump 25 is driven, the washing water stored in the sump 100 flows to the outside of the case 11 through the drainage flow path 24.

The filter 26 is installed in the communication hole 12*c* to filter out soil from the washing water moving from the tub 12 to the sump 100.

The washing pump 150 supplies the washing water stored in the sump 100 to at least one of the plurality of spray arms 13, 14, and 15. The washing pump 150 is connected to the changeover valve 130 and the washing water supply flow path 180. When the washing pump 150 is driven, the washing water stored in the sump 100 flows into the washing pump 150 through a water collecting flow path (or water catchment flow path) 170 and then is sent to the changeover valve 130 through the washing water supply flow path 180.

The washing pump 150 may heat the washing water transferred to the washing water supply flow path 180. The washing pump 150 heats the washing water stored therein to generate steam. The washing pump 150 is connected to the steam hose 190. The steam generated by the washing pump 150 is supplied to the steam nozzle 200 through the steam hose 190.

The washing pump 150 is installed on one side of the sump 100. Because any one of the known pumps may be used as the washing pump 150, detailed description thereof will be omitted here.

A heater 140 is coupled to a lower side of the washing pump 150 to heat the washing water in the washing pump 150. When the washing pump 150 operates, the heater 140 heats the washing water flowing in the washing pump 150 to generate hot water. When the washing pump 150 is stopped, the heater 140 heats the washing water stored in the washing pump 150 to generate steam.

The hot water generated by the heater 140 is sprayed into the tub 12 through at least one of the plurality of spray arms 13, 14, and 15. The steam generated by the heater 140 flows along the steam hose 190 and is discharged into the tub 12 through the steam nozzle 200.

The steam nozzle 200 is provided at a lower end of the door 20 to spray steam into the washing chamber 12*a*. The steam sprayed from the steam nozzle 200 acts on the cleaning target accommodated in the lower rack 16 and/or the upper rack 17. Details of the steam nozzle 200 will be described later with reference to FIG. 3 and the following figures.

The changeover valve 130 selectively connects the sump 100 to at least one of the plurality of spray arms 13, 14, and 15. The changeover valve 130 selectively supplies the washing water pressure-fed by the washing pump 150 to at least one of the low spray arm 13, the upper spray arm 14, and the top spray arm 15. The changeover valve 130 selectively connects the washing water supply flow path 180 to at least one of the plurality of spray arm connecting flow paths 18, 19 and 21.

A check valve 175 is disposed between the sump 100 and the washing pump 150 and opened in a direction from the sump 100. toward the washing pump 150. The check valve 175 is opened to allow the washing water to flow from the sump 100 to the washing pump 150 and closed so that steam may not flow from the washing pump 150 to the sump 100. The check valve 175 is opened as a lower portion rotates with respect to an upper portion thereof. The check valve 175 is disposed inside the water collecting flow path 170 or connected between the water collecting flow path 170 and the washing pump 150 to open and close the water collecting flow path 170.

The check valve 175 is closed when the heater 140 generates steam. The check valve 175 is opened when the washing pump 150 operates to allow the washing water to flow, and is closed when the washing pump 150 stops and the washing water does not flow. The check valve 175 is opened by a flow pressure of the washing water of the washing pump 150. According to an embodiment, the check valve 175 may be a solenoid valve that is opened or closed by an electronic signal.

The check valve 175 is formed to allow the washing water to flow from the washing pump 150 to the sump 100 even in a closed state when the drain pump 25 operates.

Figure 3:
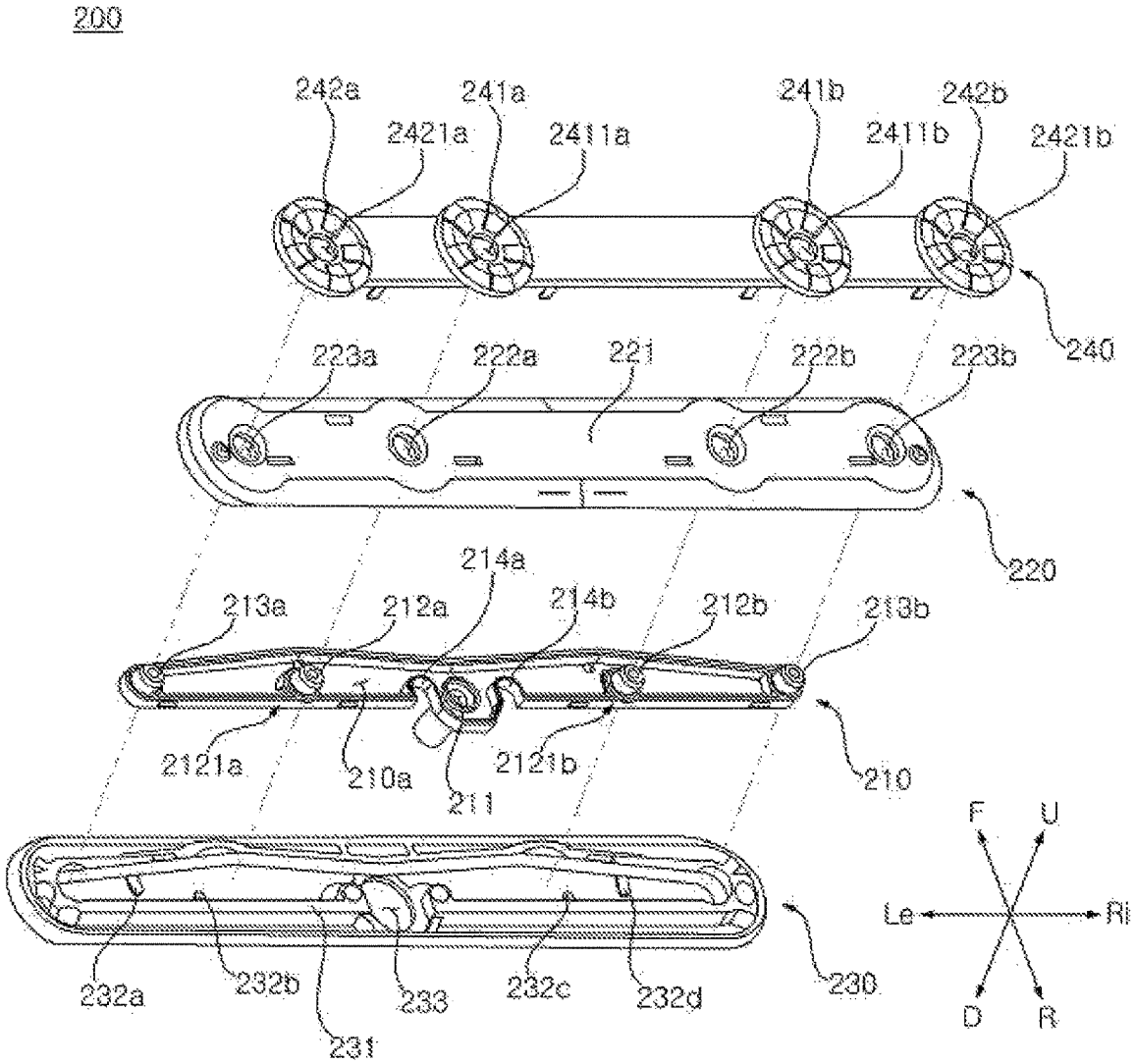
FIG. 3 is an exploded perspective view of a steam nozzle of a dishwasher according to an embodiment of the present disclosure.

FIG. 3 is an exploded perspective view of a steam nozzle of a dishwasher according to an embodiment of the present disclosure.

Figure 4:
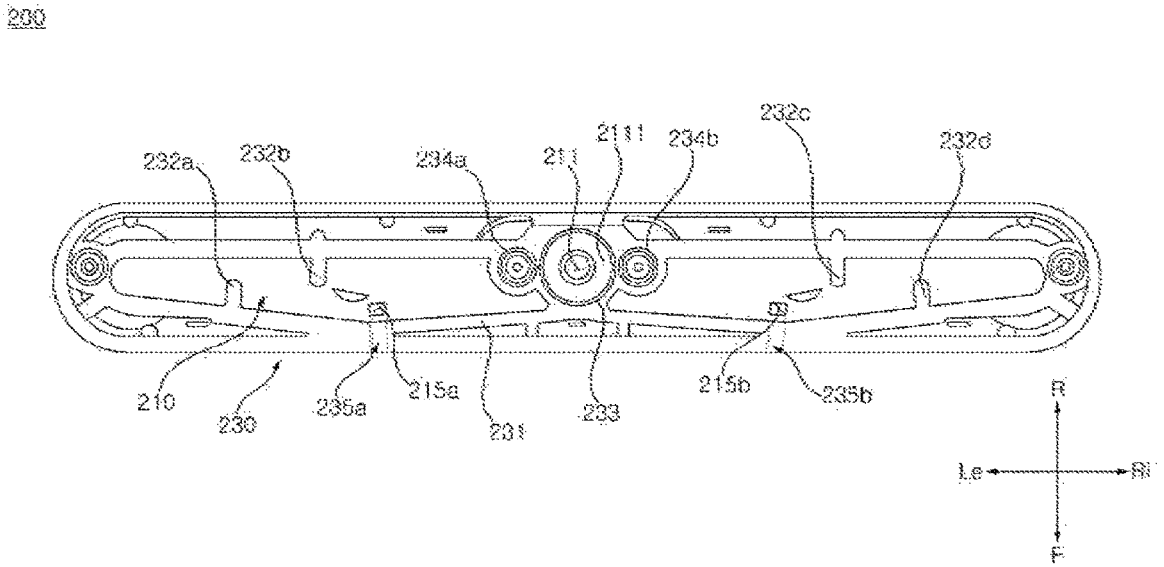
FIG. 4 is a bottom view of a steam nozzle of a dishwasher according to an embodiment of the present disclosure.

FIG. 4 is a bottom view of a steam nozzle of a dishwasher according to an embodiment of the present disclosure.

Referring to FIG. 3, the steam nozzle 200 includes a steam nozzle body 210 extending to the left and right with respect to a central portion where a steam inlet 211 is formed and having a steam accommodating portion 210*a*, an upper case 220 coupled to the steam nozzle body 210 to form the steam accommodating portion 210*a*, a lower case 230 coupled to the upper case 220 to form an internal space accommodating the steam nozzle body 210, and a steam nozzle cover 240 coupled to the upper case 220 and having steam spray orifices 2411*a*, 2411*b*, 2421*a*, and 2421*b*.

The steam nozzle body 210 may include the steam accommodating portion 210*a* in which steam and/or water is accommodated. The steam accommodating portion 210*a* may be formed by coupling the steam nozzle body 210 and the upper case 220.

In order to spray steam accommodated in the steam accommodating portion 210*a* to the washing chamber 12*a* formed in the tub 12, the steam nozzle body 210 may include a pair of first steam sprayers 212*a* and 212*b* horizontally. The pair of first steam sprayers 212*a* and 212*b* may be provided symmetrically in the steam nozzle body 210 horizontally. The pair of first steam sprayers 212*a* and 212*b* may be disposed at positions spaced apart from the steam inlet 211 by a certain distance.

The pair of first steam sprayers 212*a* and 212*b* may include tunnel flow paths 2121*a* and 2121*b* penetrating through lower ends of the first steam sprayers 212*a* and 212*b*, respectively. One end of each of the tunnel flow paths 2121*a* and 2121*b* is opened toward a central portion of the steam nozzle body 210 in which the steam inlet 211 is formed and the other end thereof is opened toward an end portion of the steam nozzle body 210 in which the second steam sprayers 213*a* and 213*b* are disposed so that steam passing through the tunnel flow paths 2121*a* and 2121*b* may flow into the second steam sprayers 213*a* and 213*b*.

The steam nozzle body 210 includes a pair of second steam sprayers 213*a* and 213*b* provided horizontally at positions farther from the steam inlet 211 than the pair of first steam sprayers 212*a* and 212*b*. The pair of second steam sprayers 213*a* and 213*b* may be disposed at positions symmetrical to each other horizontally at the steam nozzle body 210. The pair of second steam sprayers 213*a* and 213*b* may be disposed at a certain distance from the steam inlet 211, respectively. The pair of second steam sprayers 213*a* and 213*b* may be provided at both left and right ends of the steam nozzle body 210.

The steam nozzle body 210 may have coupling recesses 214*a* and 214*b* which are dented inward from a rear side of the steam nozzle body 210. In the steam nozzle body 210, widths of flow paths in the steam accommodating portion 210*a* at positions where the coupling holes 214*a* and 214*b* are formed may be narrowed to have a neck shape.

The coupling recesses 214*a* and 214*b* may have a semi-circular shape when viewed from above. Details of the steam nozzle body 210 will be described later with reference to FIG. 6 and the following figures.

The upper case 220 may have a bar type in which a length in a left-right direction is longer than a width in a front-rear direction. A lower end of the upper case 220 may have a shape corresponding to a shape of the steam nozzle body 210 and guide a coupling position of the steam nozzle body 210.

The upper case 220 may be coupled with the steam nozzle body 210 to form the steam accommodating portion 210*a*. The upper case 220 may include a pair of first upper case holes 222*a* and 222*b* into which a pair of first steam sprayers are inserted, respectively. The upper case 220 may include a pair of second upper case holes 223*a* and 223*b* into which a pair of second steam sprayers 213*a* and 213*b* are inserted, respectively.

In the upper case 220, a pair of first upper case holes 222*a* and 222*b*, into which first steam spray orifices 2124*a* and 2124*b* of the pair of first steam sprayers 212*a* and 212*b* are inserted, respectively, may be provided at positions corresponding to the first steam spray orifices 2124*a* and 2124*b*.

In the upper case 220, a pair of second upper case holes 223*a* and 223*b*, into which second steam spray orifices 2134*a* and 2134*b* of the pair of second steam sprayers 213*a* and 213*b* are inserted, respectively, may be provided at positions corresponding to the second steam spray orifices 2134*a* and 2134*b*.

Accordingly, the pair of first steam sprayers 212*a* and 212*b* may penetrate through the first upper case holes 222*a* and 222*b* of the upper case 220 and spray steam into the washing chamber 12*a* formed in the tub 12. Also, the pair of second steam sprayers 213*a* and 213*b* may penetrate through the second upper case holes 223*a* and 223*b* of the upper case 220 and spray steam into the washing chamber 12*a* formed in the tub 12.

In the upper case 220, a coupling portion to be coupled with the steam nozzle body 210 may have a E shape, so that the steam nozzle body 210 may be insertedly coupled. The coupling portion of upper case 220 may be formed of an elastic material such as rubber to enhance airtightness when the coupling portion is coupled with the steam nozzle body 210.

The upper case 220 may include a plurality of coupling rings provided at a plurality of positions and coupled with protrusions formed at the steam nozzle body 210 to maintain coupling between the upper case 220 and the steam nozzle body 210. The upper case 220 may have coupling rings corresponding to the number of positions corresponding to coupling protrusions formed on the steam nozzle body 210.

The upper case 220 includes a seating portion 221 corresponding to a shape of the steam nozzle cover 240 so that the steam nozzle cover 240 may be partially inserted and coupled.

The upper case 220 may have a plurality of coupling recesses into which the coupling rings of the steam nozzle cover 240 are inserted.

The lower case 230 may have a seating portion 231 corresponding to the shape of the steam nozzle body 210 so that the steam nozzle body 210 may be seated thereon. The lower case 230 may be coupled to the upper case 220 to form an internal space in which the steam nozzle body 210 is accommodated.

The lower case 230 may have the seating portion 231 in a shape in which the steam nozzle body 210 is projected on a lower plane of the steam nozzle body 210 so that the steam nozzle body 210 is vertically coupled.

The seating portion 231 may be opened downward so that the lower case 230 communicates with the inside of the washing chamber 12*a*. Accordingly, the water in the lower case 230 may be introduced into the washing chamber 12*a*.

In the lower case 230, stoppers 232*a*, 232*b*, 232*c*, and 232*d* for guiding a seating height of the steam nozzle body 210 protrude from the edge of the seating portion 231 to the inner side of the seating portion 231 by a predetermined length to guide a coupling position when the steam nozzle body 210 is coupled. Although not shown, the stoppers 232*a*, 232*b*, 232*c*, and 232*d* may have a shape traversing a lower end of the lower case 230.

The lower case 230 may include a steam inlet through hole 233 through which the steam inlet 211 of the steam nozzle body 210 penetrates. The lower case 230 may have the steam inlet through hole 233 having a size corresponding to the steam inlet 211 of the steam nozzle body 210. The steam inlet 211 may penetrate through the steam inlet through hole 233 and may be connected to the steam hose 190 so that steam may be introduced therethrough.

The lower case 230 may have lower case coupling portions 234*a* and 234*b* having a shape corresponding to the coupling recesses 214*a* and 214*b* of the steam nozzle body 210.

The lower case coupling portions 234*a* and 234*b* may have a size and shape to fit into the coupling recesses 214*a* and 214*b* so as to couple with the coupling recesses 214*a* and 214*b* of the steam nozzle body 210.

The lower case coupling portions 234*a* and 234*b* may have a central hole and the coupling portion provided at the upper case 220 may be inserted and coupled thereto.

The steam nozzle cover 240 may be bar-like shape in which a length in a left-right direction is longer than a width in a front-rear direction. The steam nozzle cover 240 may have a plurality of downwardly protruding coupling protrusions and may be inserted and coupled with coupling holes formed on an upper side of the upper case 220.

The steam nozzle cover 240 may have a horizontally symmetrical shape.

The steam nozzle cover 240 may include a pair of first steam cover spray orifices 241*a* and 241*b* positioned to correspond to positions of a pair of first steam spray orifices 2122*a* and 2122*b*. The steam nozzle cover 240 may include a pair of second steam cover spray orifices 242*a* and 242*b* positioned to correspond to positions of a pair of second steam spray orifices 2132*a* and 2132*b*.

The pair of first steam cover spray orifices 241*a* and 241*b* have a disc shape as a whole and spray holes 2411*a* and 2411*b* formed at the center thereof. Steam may be sprayed from the first steam spray orifices 2122*a* and 2122*b* into the washing chamber 12*a* through the spray holes 2411*a* and 2411*b*.

The pair of second steam cover spray orifices 242*a* and 242*b* may have a disc shape as a whole and spray holes

2421*a* and 2421*b* formed at the center thereof. Steam may be sprayed from the second steam spray orifices 2132*a* and 2132*b* into the washing chamber 12*a* through the spray holes 2421*a* and 2421*b*.

Figure 5:
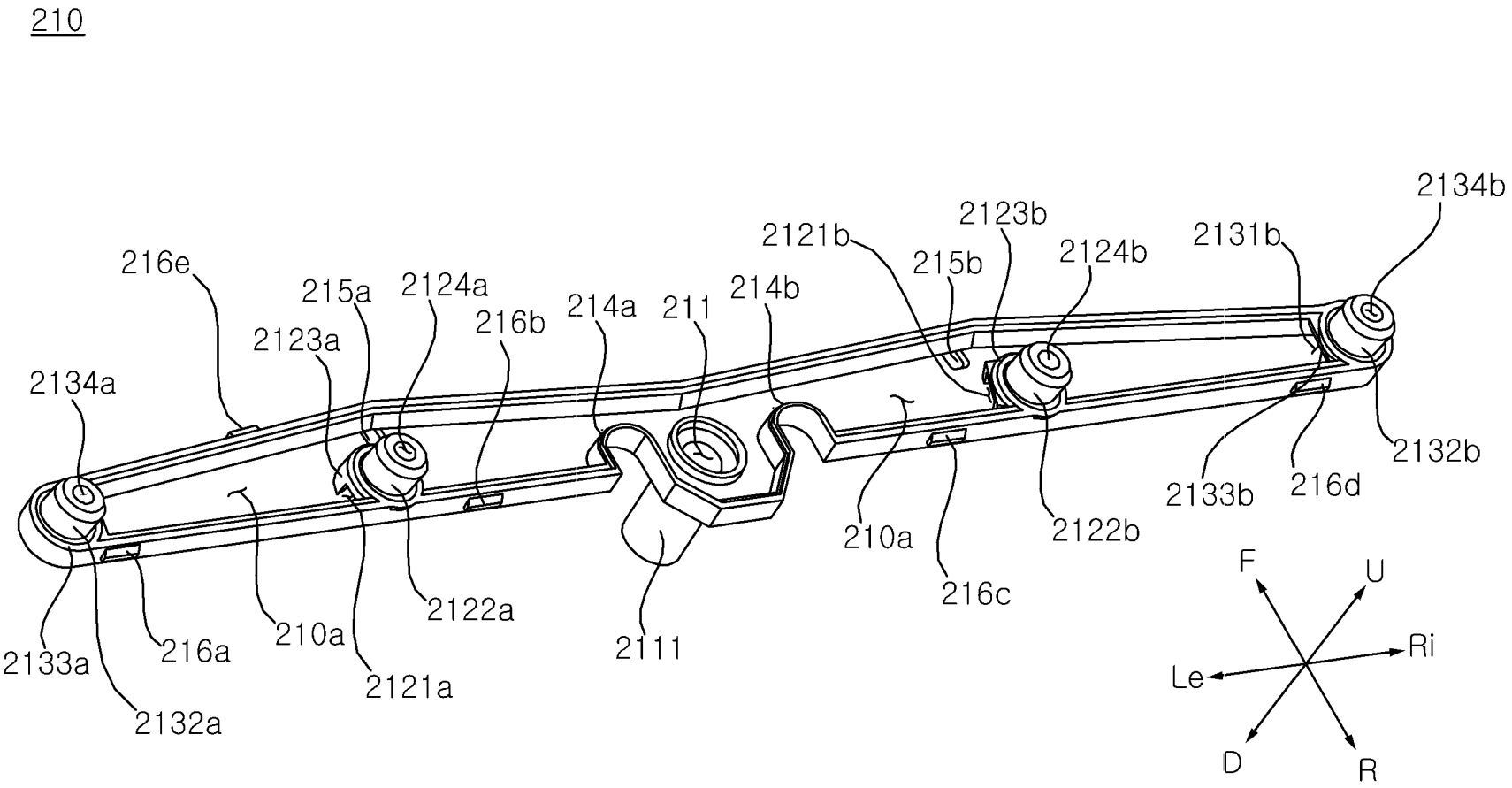
FIG. 5 is a perspective view of a steam nozzle body in a dishwasher according to an embodiment of the present disclosure.

FIG. 5 is a perspective view of a steam nozzle body in a dishwasher according to an embodiment of the present disclosure.

Figure 6:
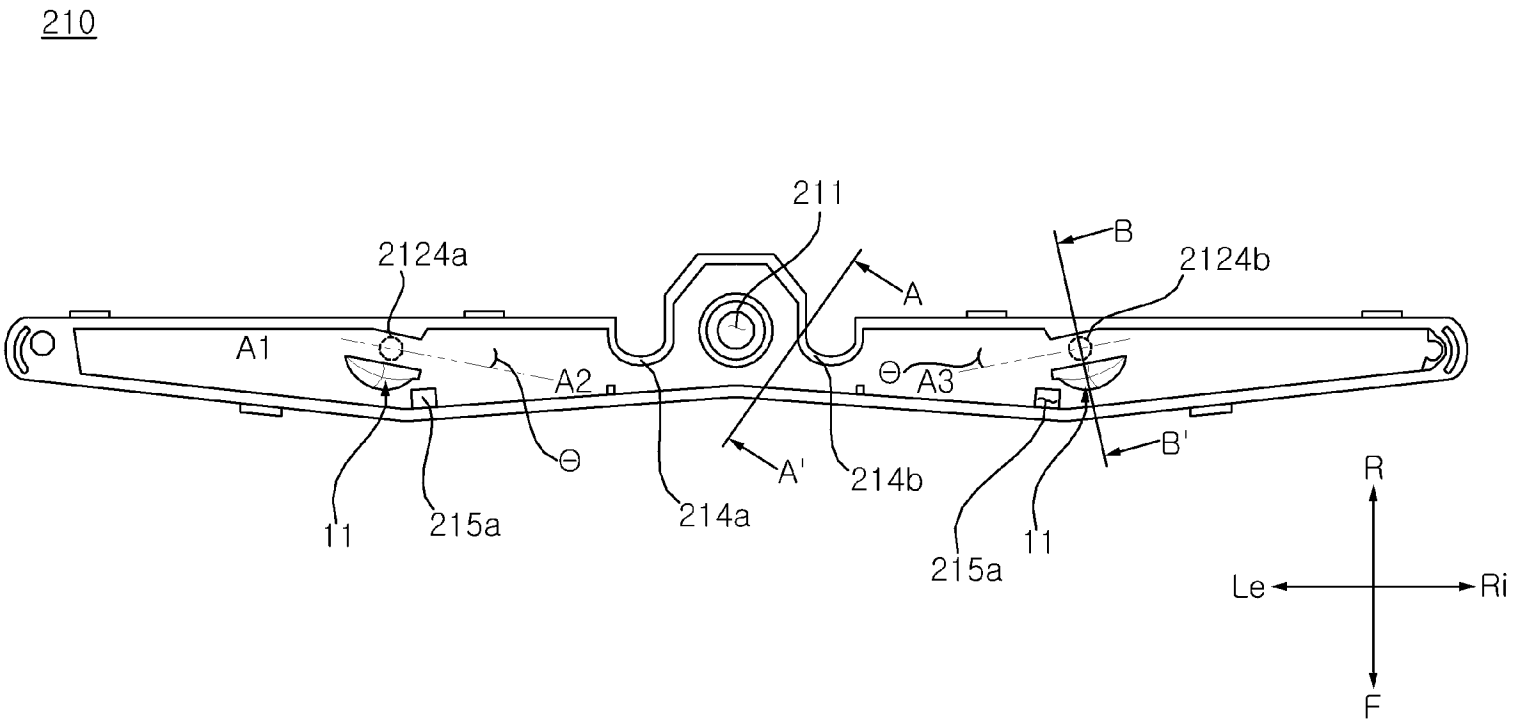
FIG. 6 is a bottom view of a steam nozzle body of FIG. 4.
Figure 7:
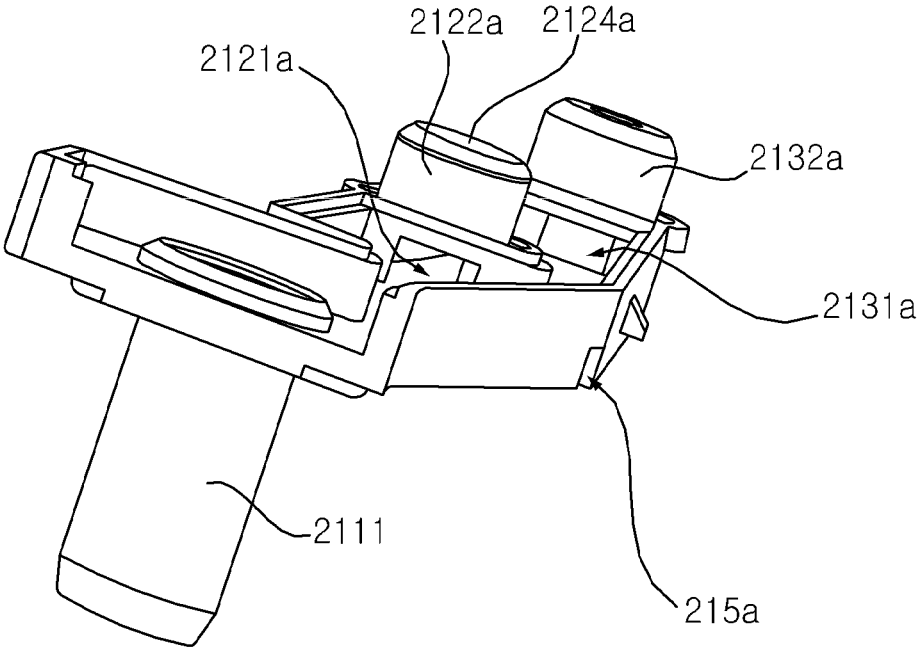
FIG. 7 is a cross-sectional view, taken along line A-A' in FIG. 6.
Figure 8:
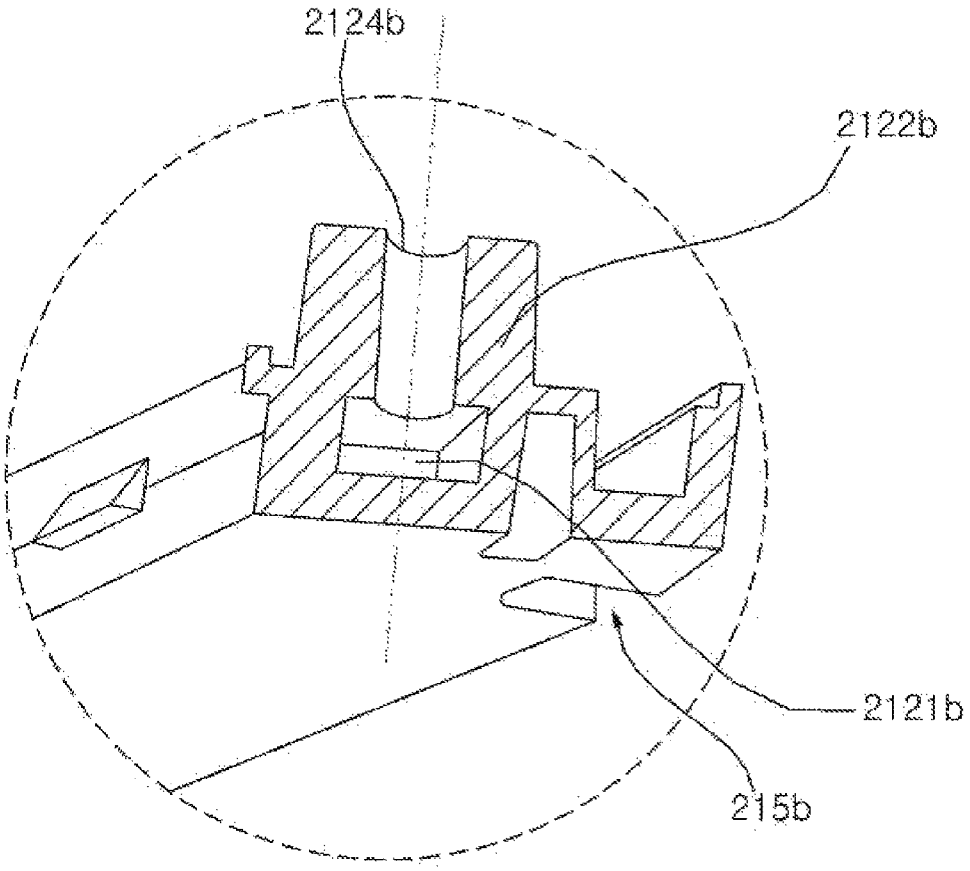
FIG. 8 is a cross-sectional view, taken along line B-B' in FIG. 6.

FIG. 6 is a bottom view of the steam nozzle body of FIG. 4, FIG. 7 is a cross-sectional view, taken along line A-A' of FIG. 6, and FIG. 8 is a cross-sectional view, taken along line B-B' of FIG. 6.

Referring to FIGS. 4 and 6, the steam nozzle body 210 may have a bar-like shape in which a length in the left-right direction is longer than a width in the front-rear direction. The steam nozzle body 210 may have a length in the left-right direction, a width in the front-rear direction, and a height in the up-and-down direction.

The steam nozzle body 210 may have the steam accommodating portion 210*a* therein to temporarily accommodate steam or water. The steam accommodating portion 210*a* may accommodate steam or water introduced into the steam nozzle body 210 through the steam inlet 211.

Front/rear and lower sides of the steam accommodating portion 210*a* may be partitioned by the steam nozzle body 210 and an upper side thereof may be partitioned by the upper case 220. That is, the steam accommodating portion 210*a* may be defined as an internal space formed as the steam nozzle body 210 and the upper case 220 are coupled.

Since the steam accommodating portion 210*a* serves as a flow path through which steam flows, it may also be referred to as a steam flow path.

The steam nozzle body 210 has the steam inlet 211 formed at a central portion thereof, and steam may be introduced from the washing pump 150. The steam nozzle body 210 may include the steam inlet 211 and a portion in which a width in a front-rear direction is larger than other portions of the steam nozzle body 210 may be referred to as a "central portion."

The steam nozzle body 210 may be shaped to extend horizontally from the center. The steam nozzle body 210 is provided to have a horizontally symmetrical shape with respect to the central portion so that the steam introduced into the steam inlet 211 may flow uniformly to the left and right. That is, the steam nozzle body 210 may be provided to be horizontally symmetrical with respect to a virtual plane traversing the center of the steam inlet 211 to extend forward/backward and up and down. Through this, the steam may be uniformly sprayed to the inside of the tub 12 through the steam sprayers.

The steam nozzle body 210 may include a steam inlet pipe 2111 extending downward by a predetermined length. The steam inlet pipe 2111 may have a hollow cylindrical shape and has the steam inlet 211 formed at the center thereof. The steam inlet pipe 2111 may be connected to the steam hose 190 so that the steam may flow into the steam nozzle body 210.

The steam inlet pipe 2111 may penetrate through the steam inlet through hole 233 of the lower case 230 and may be coupled to the steam hose.

The steam nozzle body 210 may include a pair of first steam sprayers 212*a* and 212*b* for spraying the steam from the steam accommodating portion 210*a* into the tub 12 on the right and left sides of the steam nozzle body 210. The left first steam spray hole 2124*a* and the right first steam sprayer 212*b* may be provided to be horizontally symmetrical with respect to a plane traversing the centers of the left first steam spray hole 2124*a* and the right first steam sprayer 212*b*.

The left first steam spray hole 2124*a* may be disposed to be spaced apart from the steam inlet 211 leftward by a first distance. The left first steam spray hole 2124*a* may be connected to a rear side wall of the steam nozzle body 210.

The left first steam spray hole 2124*a* may include a first steam spray orifice 2122*a* for spraying steam into the washing chamber 12*a*. An upper end of the left first steam spray hole 2124*a* may be connected to the first steam spray orifice 2122*a* and a lower end thereof may include a first steam spray orifice lower end 2123*a* connected to a lower side surface of the steam nozzle body 210.

The first steam spray orifice 2122*a* may be a hollow cylindrical spray tube extending vertically, and a first steam spray hole 2124*a* through which steam is sprayed may be formed at the center thereof.

Referring to FIG. 8, one end of the first steam spray orifice 2122*b* communicates with the tunnel flow path 2121*b* of the first steam sprayer 212*b* and the other end thereof is opened into the tub 12 so that a portion of steam introduced into the tunnel flow path 2121*b* may be sprayed into the tub 12 through the first steam spray orifice 2122*b*.

The first steam spray orifice 2122*b* may penetrate through a first upper case hole 222*b* of the upper case 220 and communicate with the washing chamber 12*a*. The first steam spray orifice 2122*b* may be inserted and coupled to the first upper case hole 222*b*.

As illustrated in FIG. 8, in the first steam spray orifice 2122*b*, a circular first steam spray hole 2124*b* through which steam is sprayed may have a predetermined diameter.

Although not shown, the first steam spray hole 2124*b* may have a shape other than the circular shape and may be formed to have a gradually decreasing diameter. Accordingly, it is possible to control a region in which the steam sprayed from the first steam spray orifice 2122*b* is sprayed to the washing chamber 12*a*. For example, the diameter of the first steam spray hole 2124*b* decreases toward the side communicating with the washing chamber 12*a* from the side connected to the tunnel flow path 2121*b* so that the steam may reach a further inside of the washing chamber 12*a*.

Referring to FIG. 8, in the first steam sprayer 212*b*, a sectional area of the tunnel flow path 2121*b* may be larger than a sectional area of the flow path of the first steam spray orifice 2122*b*. That is, the sectional area of the tunnel flow path 2121*b* may be larger than the sectional area of the first steam spray hole 2124*b*.

A portion of the steam introduced into the tunnel flow path 2121*b* may be sprayed into the washing chamber 12*a* through the first steam spray orifice 2122*b* and the rest may be introduced into the second steam spray orifice 213*b* through the tunnel flow path 2121*b*, and thus, steam spray at the second steam sprayer 213*b* may be improved.

The first steam spray orifice lower end 2123*b* may have a cylindrical shape so that the tunnel flow path 2121*b* may be formed. The tunnel flow path 2121*b* may penetrate through the first steam spray orifice lower end 2123*b* in a left-right direction. Here, the tunnel flow path 2121*b* may extend in the left-right direction in a strict sense or may extend at a certain angle with respect to the left-right direction.

A cross-section of the tunnel flow path 2121*b* may have a quadrangular shape. In the tunnel flow path 2121*b*, a lower side surface of the steam nozzle body 210 forms a lower side surface of the tunnel flow path 2121*b* so that resistance when the steam of the steam accommodating portion 210*a* flows into the tunnel flow path 2121*b* may be reduced.

Although not shown, the tunnel flow path 2121*b* may have various sectional areas such as a polygonal shape or an elliptical shape, in addition to the quadrangular shape.

The corner of an entrance of the tunnel flow path 2121*b* is rounded to reduce flow path resistance applied to the steam flowing into the tunnel flow path 2121*b*.

Referring to FIG. 6, the tunnel flow path 2121*a* may be formed such that a virtual line A1 connecting the centers of the pair of first steam sprayers 212*a* and 212*b* and directions A2 and A3 in which the tunnel flow paths 2121*a* and 2121*b* extend are at a predetermined angle (θ). For example, the predetermined angle (θ) may be an angle less than 30°.

Accordingly, since the inlet of the tunnel flow path 2121*a* is formed to correspond to a flow direction of the steam in the steam accommodating portion 210*a*, a flow path resistance applied when the steam flows into the tunnel flow path 2121*a* may be reduced and the amount of steam flowing into the tunnel flow path 2121*a* may increase.

Referring to FIGS. 5 and 6, in the present embodiment, the steam introduced into the steam inlet 211 is introduced to a flow path between the coupling holes 214*a* and 214*b* and the front wall of the steam nozzle body 210. Inner ends of the tunnel flow paths 2121*a* and 2121*b* are formed to face the flow path near the coupling holes 214*a* and 214*b* through which the steam passes and may be formed to correspond to the flow direction of the steam.

In addition, when the tunnel flow paths 2121*a* and 2121*b* are at the certain angle (θ) as illustrated in FIG. 6, the steam nozzle 200 may be easily manufactured. For example, the steam nozzle body 210 may be manufactured using a slide-type mold method, and in this case, the steam nozzle body 210 may be easily manufactured when the tunnel flow paths 2121*a* and 2121*b* are at the certain angle (θ) horizontally as illustrated in FIG. 6. A sectional area of an end portion of the tunnel flow path 2121*a* adjacent to the steam inlet 211 may be greater than a sectional area of an end portion of the tunnel flow path 2121*a* adjacent to the second steam sprayer 213*a*. Accordingly, workability of the steam nozzle body 210 may be improved.

The description of the left first steam sprayer 212*a* may be applied to the right first steam sprayer 212*b*. The right first steam sprayer 212*b* may be shaped to be symmetrical with the left first steam sprayer 212*a*.

The left second steam sprayer 213*a* may be disposed to be spaced apart from the steam inlet 211 to the left by a second distance. The second distance may be longer than the first distance.

The left second steam sprayer 213*a* may be disposed at a left end of the steam nozzle body 210.

The left second steam sprayer 213*a* may include a second steam spray orifice 2132*a* for spraying steam into the washing chamber 12*a*. The left second steam sprayer 213*a* may include the second steam spray orifice 2132*a* spraying steam into the washing chamber 12*a*. The left second steam sprayer 213*a* may include a second steam sprayer lower end 2133*a* whose upper end is connected to the second steam spray orifice 2132*a* and lower end is connected to a lower side surface of the steam nozzle body 210.

The left second steam sprayer 213*a* may include a second steam sprayer inlet 2131*a* through which steam flows from the steam accommodating portion 210*a* to the second steam sprayer 213*a*.

The second steam spray orifice 2132*a*, which is a hollow cylindrical spray pipe extending vertically, may have a second steam spray hole 2134*a* formed at a center thereof and allowing steam to be sprayed therethrough.

One end of the second steam spray orifice 2132*a* communicates with the second steam sprayer inlet 2131*a* of the second steam sprayer 213*a* and the other end thereof is opened to the inside of the tub 12 so that steam introduced to the second steam sprayer inlet 2131*a* may be sprayed into the tub 12 through the second steam spray orifice 2132*a*.

The second steam spray orifice 2132*a* may penetrate through the second upper case hole 223*a* of the upper case 220 and communicate with the washing chamber 12*a*. The second steam spray orifice 2132*a* may be inserted and coupled to the second upper case hole 223*a*.

In the second steam spray orifice 2132*a*, the circular second steam spray hole 2134*a* through which steam is sprayed may have a certain diameter.

Although not shown, the second steam spray hole 2134*a* may have a shape other than the circular shape and may be formed such that a diameter thereof is gradually reduced. Accordingly, it is possible to control a region in which the steam sprayed from the second steam spray orifice 2132*a* is sprayed into the washing chamber 12*a*. For example, the diameter of the second steam spray hole 2134*a* decreases toward the side communicating with the washing chamber 12*a* from the side connected to the tunnel flow path 2121*a* so that the steam may reach a further inner side of the washing chamber 12*a*.

Referring to FIGS. 3 to 8, in the second steam sprayer 213*a*, a sectional area of the second steam sprayer inlet 2131*a* may be greater than a sectional area of a flow path of the second steam spray hole 2134*a*. That is, the sectional area of the second steam sprayer inlet 2131*a* may be greater than the sectional area of the second steam spray hole 2134*a*

Accordingly, when a flow rate is constant, a flow velocity is in inverse proportional to the sectional area, and thus, when the steam introduced into the second steam sprayer inlet 2131*a* is sprayed through the second steam spray hole 2134*a*, the flow rate of steam may be increased. Therefore, the steam spray at the second steam sprayer 213*a* may be improved.

The second steam sprayer lower end 2133*a* may have a cylindrical shape and opened toward the center of the steam nozzle body 210 to form the second steam sprayer inlet 2131*a*.

A cross-section of the second steam sprayer inlet 2131*a* may have a quadrangular shape. As a lower side surface of the steam nozzle body 210 forms a lower side surface of the second steam sprayer inlet 2131*a*, whereby resistance applied when the steam of the steam accommodating portion 210*a* is introduced to the second steam sprayer inlet 2131*a* may be reduced.

Although not shown, the second steam sprayer inlet 2131*a* may have various sectional areas such as a polygonal shape or an elliptical shape in addition to the quadrangular shape.

The corner of an entrance of the second steam sprayer inlet 2131*a* is rounded to reduce resistance applied to the steam introduced into the second steam sprayer inlet 2131*a*.

The right second steam sprayer 213*b* may be provided symmetrically with the left second steam sprayer 213*a*. As for the right second steam sprayer 213*b*, the description of the left second steam sprayer 213*a* may be applied.

The steam nozzle body 210 may have a pair of drain holes 215*a* and 215*b* formed on the left and right and allowing water in the steam accommodating portion 210*a* to be discharged therethrough. The drain holes 215*a* and 215*b* may be holes formed on a lower surface and/or a front surface of the steam nozzle body 210.

Referring to FIGS. 6 and 7, the left drain hole 215*a* may be provided between the steam inlet 211 and the left first steam spray hole 2124*a*.

The left drain hole 215*a* may be formed at a flow path between the first steam sprayer 212*a* and a front wall of the steam nozzle body 210. That is, the left drain hole 215*a* may be formed near the first steam discharging end 212*a*, which is a portion where the width of the steam accommodating portion 210*a* in the front-rear direction is reduced.

The right drain hole 215*b* may be provided symmetrically with the left drain hole 215*a*. Regarding the right drain hole 215*b*, the description of the left drain hole 215*a* may be applied.

When the steam is introduced from the washing pump 150 through the steam inlet 211, washing water, as well as the steam, may also be introduced together to the steam nozzle 200. The water introduced to the steam nozzle 200 may be discharged into the tub 12 through the drain holes 215*a* and 215*b* formed as described above by gravity. The steam having a density lower than that of water may be sprayed from the first steam sprayers 212*a* and 212*b* and the second steam sprayers 213*a* and 213*b* of the steam nozzle 200.

Referring to FIG. 4, the lower case 230 may include drain recesses 235*a* and 235*b* having shapes corresponding to the drain holes 215*a* and 215*b* of the steam nozzle body 210. The drain recesses 235*a* and 235*b* may have a width corresponding to positions corresponding to the drain holes 215*a* and 215*b*.

Alternatively, drain holes may be formed at the lower case 230 to correspond to the drain holes 215*a* and 215*b*.

Accordingly, water may be discharged from the steam accommodating portion 210*a* into the tub 12.

The steam nozzle body 210 may include a plurality of coupling protrusions 216*a* to 216*f* protruding outward from a front wall or a rear wall of the steam nozzle body 210. Each of the plurality of coupling protrusions 216*a* to 216*f* may be coupled with a coupling portion provided in the upper case 220 or with a coupling portion provided at the lower case 230. Accordingly, the steam nozzle body 210 may be coupled with the upper case 220 or the lower case 230.

Referring to FIGS. 6 and 7, the steam nozzle body 210 may have a shape in which a width a flow path is narrowed from the first steam sprayer to the second steam sprayer. That is, the steam nozzle body 210 may have a shape in which the width of the steam accommodating portion 210*a* in the front-rear direction is narrowed from the first steam sprayer to the second steam sprayer.

The steam nozzle 200 configured as described above is configured such that the steam introduced into the steam inlet 211 is effectively transferred to the first steam sprayers 212*a* and 212*b* and the second steam sprayers 213*a* and 213*b*, whereby steam may be uniformly sprayed from both ends of the nozzle 200.

In particular, the tunnel flow paths 2121*a* and 2121*b* provided at the first steam sprayers 212*a* and 212*b* may improve flow of the steam introduced into the second steam sprayers 213*a* and 213*b*, resultantly improving steam spray at the second steam sprayers 213*a* and 213*b*.

In the case of the first steam sprayers 212*a* and 212*b*, a distance from the steam inlet 211 is closer to that of the second steam sprayers 213*a* and 213*b* so that the steam pressure-fed with a high pressure by the washing pump 150 may be easily spread through the first and second steam sprayers 212*a* and 212*b*. In contrast, in the case of the second steam sprayers 213*a* and 213*b*, a distance from the steam inlet 211 is farther than the first steam sprayers 212*a* and 212*n*, the first steam sprayers 212*a* and 212*b* are positioned between the steam inlet 211 and the second steam sprayers 213*a* and 213*b*, and a steam flow path is provided such that an introduction to the first steam sprayers 212*a* and 212*b* is easy, so that a steam spray amount from the second steam sprayers 213*a* and 213*b* is not uniform.

Thus, by forming the tunnel flow paths 2121*a* and 2121*b* at the first steam sprayers 212*a* and 212*b*, the steam may be uniformly sprayed from the first steam sprayers 212*a* and 212*b* and the second steam sprayers 213*a* and 213*b*.

Figure 9:
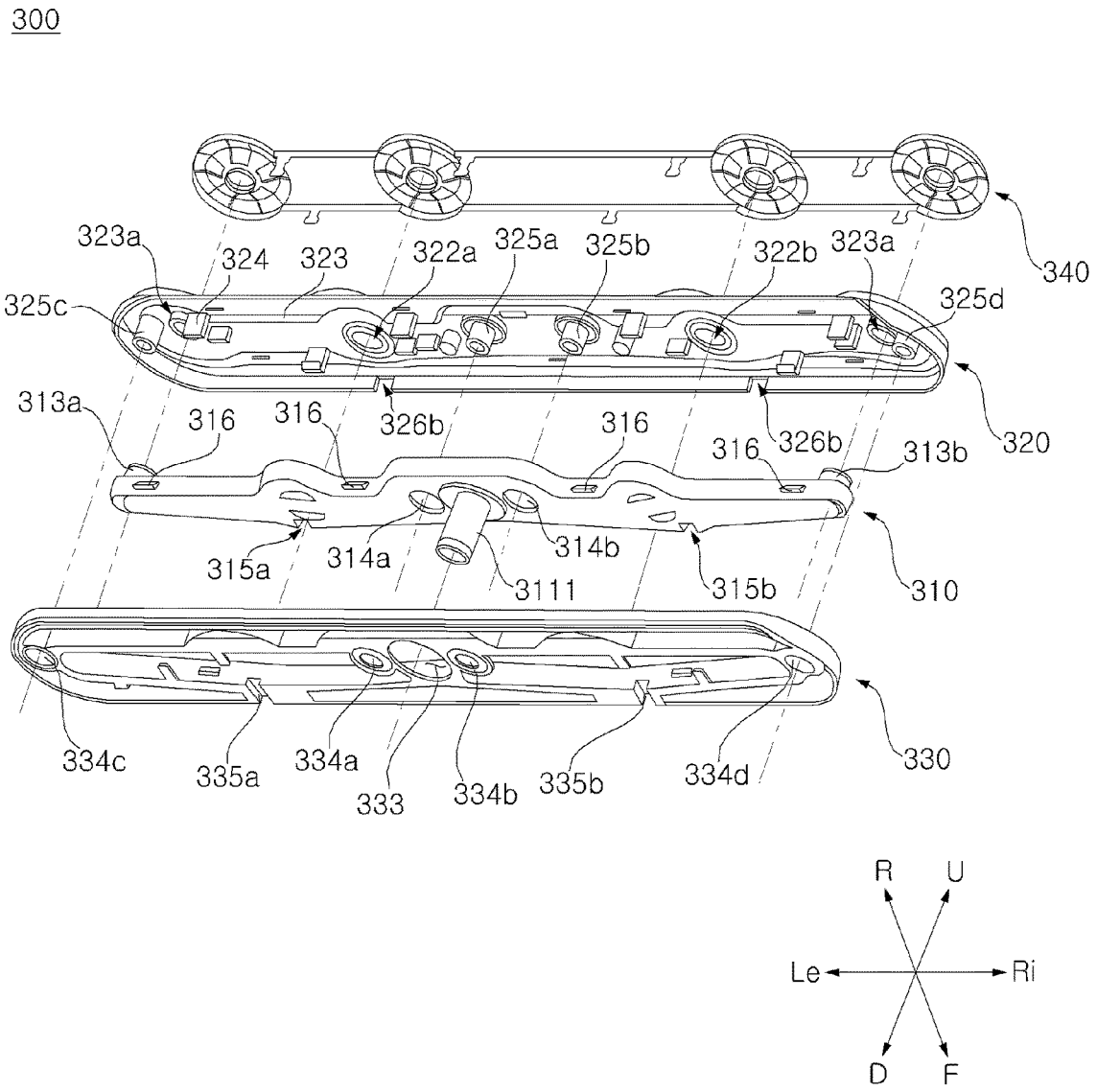
FIG. 9 is an exploded perspective view of a steam nozzle in a dishwasher according to another embodiment of the present disclosure.

FIG. 9 is an exploded perspective view of a steam nozzle in a dishwasher according to another embodiment of the present disclosure.

Figure 10:
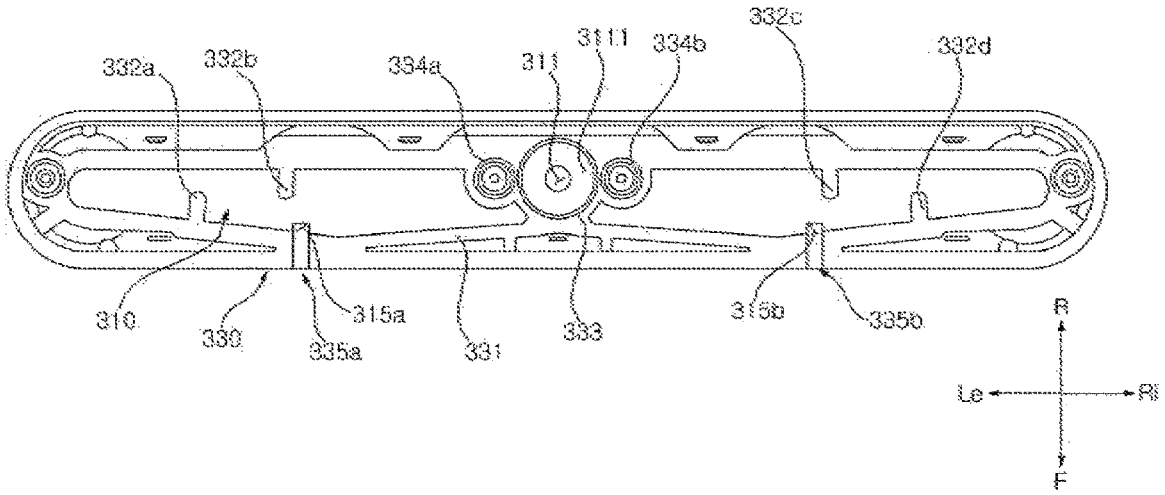
FIG. 10 is a bottom view of a steam nozzle of a dishwasher according to another embodiment of the present disclosure.

FIG. 10 is a bottom view of a steam nozzle of a dishwasher according to another embodiment of the present disclosure.

Hereinafter, a steam nozzle 300 of a dishwasher according to another embodiment of the present disclosure will be described with reference to FIG. 9 and the following figures, and here, only parts different from those of the steam nozzle of the dishwasher according to the embodiment of the present disclosure described above will be described.

In the upper case 320, a pair of first upper case holes 322*a* and 322*b*, into which a first steam spray orifice 3122*a* of a pair of first steam spray orifices 312*a* and 312*b* is inserted, may be provided at a position corresponding to the first steam spray orifice 3122*a*. In the upper case 320, a pair of second upper case holes 323*a* and 323*b*, into which a second steam spray orifice 3132*a* of a pair of second steam spray orifices 313*a* and 313*b* is inserted, may be provided at a position corresponding to the second steam spray orifice 3132*a*.

The upper case 320 may have a coupling portion 323 for coupling with the steam nozzle body 310. The coupling portion 323 may have a shape corresponding to the shape of the steam nozzle body 310.

A cross-section of the coupling portion 323 may have a E shape so that the steam nozzle body 310 may be partially inserted into the coupling portion 323 so as to be coupled. The upper case 320 may have an elastic member such as rubber in the coupling portion 323 to enhance airtightness when coupled with the steam nozzle body 310.

The upper case 320 may include a plurality of coupling rings 324 which are caught by protrusions formed at the steam nozzle body 310 so as to maintain coupling between the upper case 320 and the steam nozzle body 310. The upper case 320 may have the number of coupling rings 324 corresponding to positions corresponding to the coupling protrusions formed on the steam nozzle body 310.

The upper case 320 may have a plurality of coupling recesses into which the coupling rings of the steam nozzle cover 340 are inserted and coupled.

The upper case 320 may include coupling bosses 325*a*, 325*b*, 325*c*, and 325*d*, which are inserted and coupled to lower case coupling portions 334*a*, 334*b*, 334*c*, and 334*d*. The coupling bosses 325*a* and 325*b* may be coupled to the lower case coupling portions 334*a* and 334*b* through coupling holes 314*a* and 314*b* of the steam nozzle body 310. Accordingly, the upper case 320, the steam nozzle body 310, and the lower case 330 may be coupled.

The description of the low case 230 according to the embodiment of the present disclosure may be applied to the low case 330 as is. However, a seating portion of the lower case 330 may be partially changed in shape corresponding to a shape of the steam nozzle body 310.

The description of the steam nozzle cover 240 according to an embodiment may be applied as is to the steam nozzle cover 340.

Figure 11:
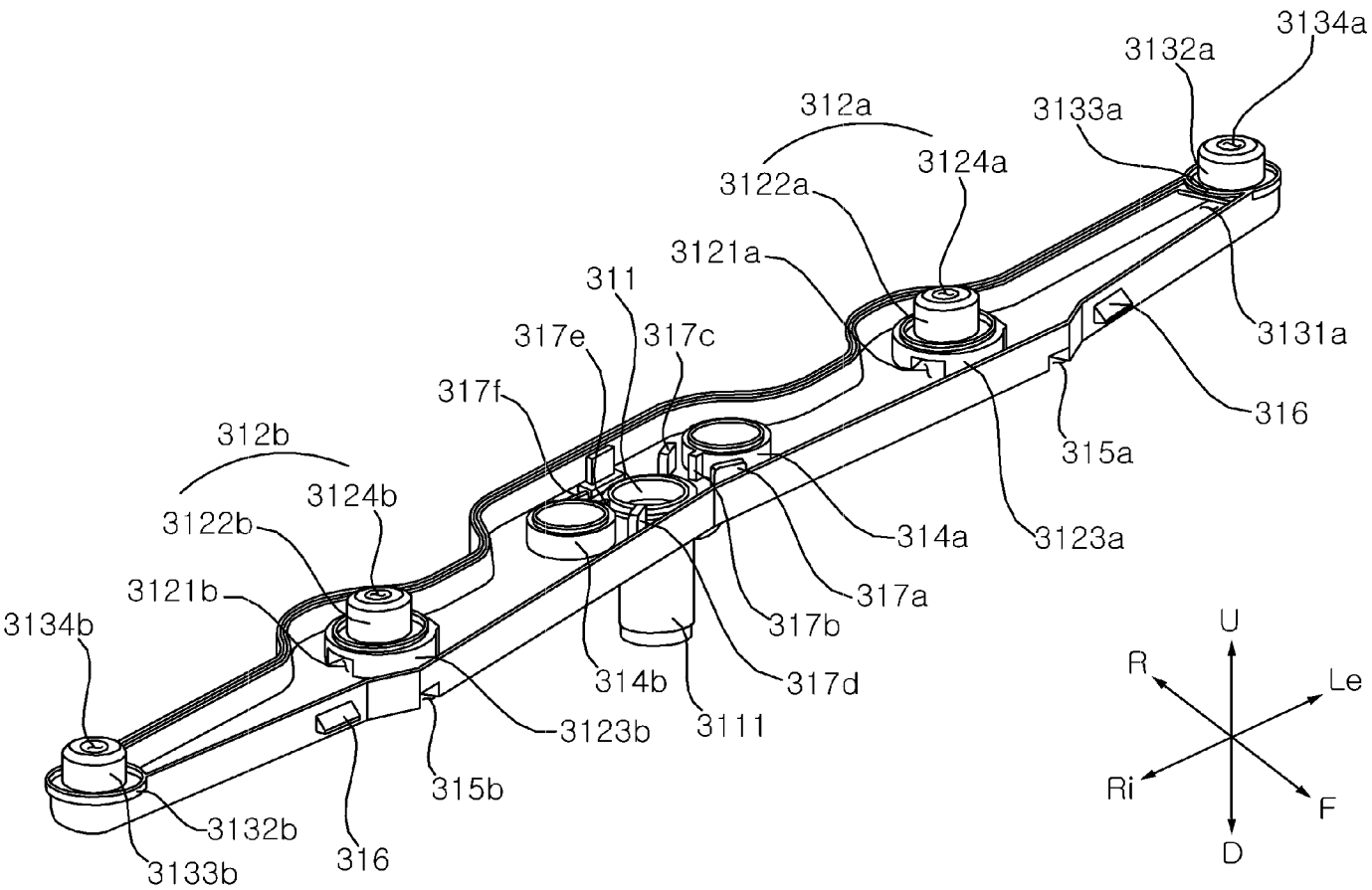
FIG. 11 is a perspective view of a steam nozzle body in a dishwasher according to another embodiment of the present disclosure.

FIG. 11 is a perspective view of a steam nozzle body in a dishwasher according to another embodiment of the present disclosure.

The steam nozzle body 310 may have a bar-like shape in which a length in a left-right direction is longer than a width in a front-rear direction, as in the steam nozzle body 210 according to an embodiment overall.

The steam nozzle body 310 may have a steam accommodating portion 310*a* on an inner circumference thereof to temporarily accommodate steam or water. That is, the steam accommodating portion 310*a* may serve as a flow path for discharging steam or water, which has been introduced through the steam inlet 311, through a steam spray orifice.

The steam nozzle body 310 has the steam inlet 311 at the center thereof, and steam may be introduced from the washing pump 150 therethrough.

The steam nozzle body 310 may include a steam inlet 311, coupling holes 314*a* and 314*b*, and guide ribs 317*a* to 317*f* at a central portion thereof.

The steam nozzle body 310 may have a shape symmetrical horizontally with respect to the central portion. Accordingly, the steam introduced into the steam inlet 311 may be uniformly introduced to the left and right of the steam nozzle body 310 so that the steam may be uniformly sprayed into the tub 12 through a steam sprayer.

The steam nozzle body 310 may include a steam inlet pipe 3111 extending downward by a predetermined length. The steam inlet pipe 3111 may have a hollow cylindrical shape and have a steam inlet 311 formed at the center thereof. The steam inlet pipe 3111 is connected to the steam hose 190 so that steam may flow into the steam nozzle body 310.

The steam inlet pipe 3111 may be coupled to the steam hose through a steam inlet through hole 333 of the lower case 330.

The steam nozzle body 310 includes a pair of first steam sprayers 312*a* and 312*b* for spraying the steam in the steam accommodating portion 310*a* into the tub 12 on the right and left sides of the steam nozzle body 310. The left first steam sprayer 312*a* and the right first steam sprayer 312*b* may be provided to be horizontally symmetrical with respect to a plane traversing the centers of the left first steam sprayer 312*a* and the right first steam sprayer 312*b* in up-down and front-rear directions.

The left first steam spray hole 3124*a* may be disposed to be spaced apart from the steam inlet leftward by a first distance. The left first steam spray hole 3124*a* may be provided to be separated from a front side wall and a rear side wall of the steam nozzle body 310.

The left first steam spray hole 3124*a* may include a first steam spray hole 3122*a* spraying steam into the washing chamber 12*a*. The left first steam spray hole 3124*a* may include a first steam sprayer lower end 3123*a* having an upper end connected to the first steam spray orifice 3122*a* and a lower end connected to a lower side surface of the steam nozzle body 310.

The first steam spray orifice 3122*a* is a hollow cylindrical spray pipe extending vertically, and a first steam spray hole 3124*a* through which steam is sprayed may be formed at the center thereof.

The steam nozzle body 310 may include a flow path encircling the first steam sprayer. The steam nozzle body 310 may include a flow path formed by a lower end 3123*a* of the first steam sprayer and a front side wall of the steam nozzle body 310. The steam nozzle body 310 may include a flow path formed by a first steam sprayer lower end 3123*a* and a rear side wall of the steam nozzle body 310.

The steam nozzle body 310 may protrude backward to correspond to the shape of the first steam sprayer 312*a* at a position where the first steam sprayer 312*a* is disposed, to form a flow path bypassing the first steam sprayer 312*a*.

One end of the first steam spray orifice 3122*a* may communicate with a tunnel flow path 3121*a* of the first steam sprayer 312*a* and the other end thereof may be opened to the inside of the tub 12 so that a portion of steam introduced into the tunnel flow path 3121*a* may be sprayed into the tub 12 through the first steam spray orifice 3122*a*.

The first steam spray orifice 3122*a* may communicate with the washing chamber 12*a* through the first upper case hole 322*a* of the upper case 320. The first steam spray orifice 3122*a* may be inserted and coupled to the first upper case hole 322*a*.

A sectional area of the tunnel flow path 3121*a* may be larger than a sectional area of the flow path of the first steam inlet 3122*a*. The sectional area of the tunnel flow path 3121*a* may be larger than a sectional area of the first steam spray hole 3124*a*.

A portion of the steam introduced into the tunnel flow path 3121*a* may be sprayed into the washing chamber 12*a* through the first steam spray orifice 3122*a* and the rest may be introduced into the second steam sprayer 313*a* through the tunnel flow path 3121*a*, thus enhancing steam spray at the second steam sprayer 313*a*.

The first steam sprayer lower end 3123*a* may have a cylindrical shape, and the tunnel flow path 3121*a* may be formed. The tunnel flow path 3121*a* may penetrate through the first steam sprayer lower end 3123*a* in the left-right direction. Here, the tunnel flow path 3121*a* may extend in the right-left direction in a strict sense or may extend at a predetermined angle with respect to the left-right direction.

For example, an angle formed by a virtual straight line connecting the center of the left end and the center of the right end with the left-right direction may form a certain angle (θ).

A cross-section of the tunnel flow path 3121*a* may have a quadrangular shape. In the tunnel flow path 3121*a*, a lower side surface of the steam nozzle body 310 forms a lower side surface of the tunnel flow path 3121*a* so that resistance applied when the steam of the steam accommodating portion 310*a* flows into the tunnel flow path 3121*a* may be reduced.

Although not shown, the tunnel flow path 3121*a* may have various sectional areas such as a polygonal shape or an elliptical shape, in addition to the quadrangular shape.

The corner of an entrance of the tunnel flow path 3121*a* is rounded to reduce flow path resistance applied to the steam flowing into the tunnel flow path 3121*a*.

A sectional area of an inner end of the tunnel flow path 3121*a* closer to the steam inlet 311 may be larger than a sectional area of an outer end of the tunnel flow path 3121*a* closer to the second steam sprayer 313*a*. Here, since a portion of the steam flowing into the tunnel flow path 3121*a* is discharged through the steam spray orifice, the amount of steam discharged from the outer end of the tunnel flow path 3121*a* decreases. Here, by reducing the sectional area of the outer end of the tunnel flow path 3121*a*, pressure drop of the steam discharged from the outer end of the tunnel flow path 3121*a* may be reduced and flow of steam may be improved.

The left second steam sprayer 313*a* may be disposed to be farther from the steam inlet 311 than the left first steam spray hole 3124*a*. The left second steam sprayer 313*a* may be disposed at a left end of the steam nozzle body 310.

The left second steam sprayer 313*a* may include a second steam spray orifice 3132*a* for spraying steam into the washing chamber 12*a*. The left second steam sprayer 313*a* may include a second steam sprayer lower end 3133*a* having an upper end connected to the second steam spray orifice 3132*a* and a lower end connected to a lower surface of the steam nozzle body 310.

The left second steam sprayer 313*a* may include a second steam sprayer inlet 3131*a* through which steam flows from the steam accommodating portion 310*a* to the second steam sprayer 313*a*.

The second steam spray orifice 3132*a* may be a hollow cylindrical spray pipe extending vertically. A second steam spray hole 3134*a* through which steam is sprayed may be formed at the center of the second steam spray hole 3132*a*.

The second steam spray orifice 3132*a* may have one end communicating with the second steam sprayer inlet 3131*a* of the second steam sprayer 313*a* and the other end opened to the inside of the tub 12, so that the steam introduced through the second stem sprayer inlet 3131*a* may be sprayed to the inside of the tub 12 through the second steam spray orifice 3132*a*.

The second steam spray orifice 3132*a* may communicate with the washing chamber 12*a* through the second upper case hole 323*a* of the upper case 320. The second steam spray orifice 3132*a* may be inserted and coupled to the second upper case hole 323*a*.

The second steam spray orifice 3132*a* may be formed at the center of the second steam spray hole 3134*a* so that the steam may be sprayed through the second steam spray hole 3134*a*.

Although not shown, the second steam spray hole 3124*a* may have a shape other than the circular shape and may be formed to have a gradually decreasing diameter. Accordingly, it is possible to control a region in which the steam sprayed from the second steam spray orifice 3132*a* is sprayed to the washing chamber 12*a*. For example, the diameter of the second steam spray hole 3134*a* decreases toward the side communicating with the washing chamber 12*a* from the side connected to the tunnel flow path 3121*a* so that the steam may reach a further inside of the washing chamber 12*a*.

Referring to FIG. 11, in the second steam sprayer 313*a*, a sectional area of the second steam sprayer inlet 3131*a* may be greater than a sectional area of a flow path of the second steam spray hole 3134*a*. That is, the sectional area of the second steam sprayer inlet 3131*a* may be greater than the sectional area of the second steam spray hole 3134*a*.

Accordingly, when the steam flowing into the second steam sprayer inlet end 3131*a* may be sprayed in a further accelerated manner through the second steam spray hole 3134*a*. Thus, a distance by which the steam sprayed from the second steam sprayer 313*a* reaches the washing chamber 12*a* may be increased.

The second steam sprayer lower end 3133*a* may have a cylindrical shape and opened toward the center of the steam nozzle body 310 to form the second steam sprayer inlet 3131*a*.

The second steam sprayer inlet end 3131*a* may be formed by a front side wall, a rear side wall, and a lower side surface of the steam nozzle body 310 and the second steam sprayer lower end 3133*a*. As the lower side surface of the steam nozzle body 310 forms the lower side surface of the second steam sprayer inlet 3131*a*, resistance applied when the steam from the steam accommodating portion 310*a* flows into the second steam sprayer inlet 3131*a* may be reduced.

Although not shown, the second steam sprayer inlet 3131*a* may have various sectional areas such as a polygonal shape or an elliptical shape, in addition to the quadrangular shape.

The corner of an entrance of the second steam sprayer inlet 3131*a* is rounded to reduce resistance applied to the steam introduced into the second steam sprayer inlet 3131*a*.

The steam nozzle body 310 may have a pair of drain holes 315*a* and 315*b* formed on the left and right and allowing water in the steam accommodating portion 210*a* to be discharged therethrough. The drain holes 215*a* and 215*b* may be holes formed on a lower surface and/or a front surface of the steam nozzle body 310.

Referring to FIGS. 6 and 7, the left drain hole 315*a* may be provided between the steam inlet 311 and the left first steam spray hole 3124*a*.

The left drain hole 315*a* may be formed at a flow path between the first steam sprayer 312*a* and a front wall of the steam nozzle body 310. That is, the left drain hole 315*a* may be formed near the first steam discharging end 312*a*, which is a portion where the width of the steam accommodating portion 310*a* in the front-rear direction is reduced.

The left drain hole 315*a* may be formed at a rear end of the flow path between the first steam sprayer 312*a* and the front wall of the steam nozzle body 310.

The right drain hole 315*b* may be provided symmetrically with the left drain hole 315*a*. Regarding the right drain hole 315*b*, the description on the left drain hole 315*a* may be applied.

When the steam is introduced from the washing pump 150 through the steam inlet 311, washing water, as well as the steam, may also be introduced together to the steam nozzle 300.

The water introduced to the steam nozzle 300 may be discharged to the outside of the steam nozzle 300 through the drain holes 315*a* and 315*b* by gravity. Meanwhile, the steam having a density lower than that of water may flow along the steam accommodating portion 310*a* and may be sprayed from the first steam sprayers 312*a* and 312*b* and the second steam sprayers 313*a* and 313*b*.

Referring to FIGS. 9 and 10, the lower case 330 may include drain recesses 335*a* and 335*b* having shapes corresponding to the drain holes 315*a* and 315*b* of the steam nozzle body 310. The drain recesses 335*a* and 335*b* may have a width corresponding to positions corresponding to the drain holes 315*a* and 315*b*.

Referring to FIG. 9, the upper case 320 may include drain recesses 326*a* and 326*b* having shapes corresponding to the drain holes 315*a* and 315*b* of the steam nozzle body 310. The drain recesses 326*a* and 326*b* may have a width corresponding to positions corresponding to the drain holes 315*a* and 315*b*.

Although not shown, the lower case 330 may have drain holes formed to correspond to the drain holes 315*a* and 315*b*. Although not shown, the upper case 320 may have drain holes formed to correspond to the drain holes 315*a* and 315*b*.

Accordingly, water may be discharged from the steam accommodating portion 310*a* into the tub 12.

The steam nozzle body 310 may include a plurality of coupling protrusions 316 protruding outward from the front wall or the rear wall of the steam nozzle body 310. Each of the plurality of coupling protrusions 316 may be coupled with the coupling portion provided on the upper case 320 or with the coupling portion provided on the lower case 330. Accordingly, the steam nozzle body 310 may be coupled with the upper case 320 or the lower case 330.

Referring to FIG. 11, the steam nozzle body 310 may have a shape in which a width of the flow path is narrowed from the first steam sprayer 312*a* to the second steam sprayer 313*a*. That is, the steam nozzle body 310 may have a shape in which the width of the steam accommodating portion 310*a* in the front-rear direction is narrowed from the first steam sprayer to the second steam sprayer.

Referring to FIG. 11, the steam nozzle body 310 may have one or more guide ribs 317*a* to 317*f* guiding the steam introduced to the steam inlet 311 to the pair of first steam sprayers 312*a* and 312*b*.

For example, the steam nozzle body 310 may include one or more radial guide ribs 317*a* to 317*f* based on the steam inlet 311 as a center. Thus, the steam introduced into the steam inlet 311 may be guided to the first steam sprayer 312*a*.

The guide ribs 317*a* to 317*f* may be plate-shaped ribs adjacent to the steam inlet 311 and extending from the center of the steam inlet 311 in a radial direction by a predetermined length. The guide ribs 317*a* to 317*f* may be provided in a shape to be symmetrical horizontally.

The guide ribs 317*a* to 317*f* may include guide ribs 317*b* and 317*e* connected to the coupling holes 314*a* and 314*b*. The guide ribs 317*a* to 317*f* may include guide ribs 317*a* and 317*d* provided between the coupling holes 314*a* and 314*b* and the front wall of the steam nozzle body 310. The guide ribs 317*a* to 317*f* may include guide ribs 317*c* and 317*f* provided between the coupling holes 314*a* and 314*b* and the rear wall of the steam nozzle body 310.

The guide ribs 317*a* to 317*f* may be provided to have a height corresponding to a height of the side wall of the steam nozzle body 310 so as to be in contact with the upper case 320.

The steam nozzle body 310 may have a pair of coupling holes 314*a* and 314*b* formed on both sides of the steam inlet 311 at the central portion thereof so that coupling bosses 325*a* and 325*b* of the upper case 320 may penetrate therethrough so as to be coupled. The coupling holes 314*a* and 314*b* may have a diameter corresponding to a size of the coupling bosses 325*a* and 325*b* of the upper case 320, so that the coupling bosses 325*a* and 325*b* may be inserted into the coupling holes 314*a* and 314*b*.

The coupling holes 314*a* and 314*b* may have a hollow cylindrical shape protruding from a lower side surface of the steam nozzle body 310 by a predetermined length. The coupling holes 314*a* and 314*b* may have a height extending from the lower side surface of the steam nozzle body 310 to a lower side surface of the upper case 320.

The coupling bosses 325*a* and 325*b* of the upper case 320 may penetrate through the coupling holes 314*a* and 314*b* and may be coupled with the lower case coupling portions 334*a* and 334*b*. Accordingly, the upper case 320, the steam nozzle body 310, and the lower case 330 may be coupled with each other.

The steam nozzle body 310 may include a flow path encircling the coupling holes 314*a* and 314*b*. The steam nozzle body 310 may include a flow path between the coupling holes 314*a* and 314*b* and the front wall of the steam nozzle body 310 and a flow path between the coupling holes 314*a* and 314*b* and the rear wall of the steam nozzle body 310. The steam or water flowing into the steam inlet 311 may flow toward the first steam sprayer 312*a* along the flow paths formed before and after the coupling holes 314*a* and 314*b*. Accordingly, flow of the steam moving from the steam inlet 311 to the first steam sprayer 312*a* and the second steam sprayer 313*a* may be improved and steam may be effectively sprayed from the steam sprayer.

In the steam nozzle 300 configured as described above, flow path resistance applied to the steam introduced to the steam inlet 311 and then introduced to the first steam sprayers 312*a* and 312*b* may be reduced further than that of the steam nozzle 200.

That is, the steam or water flowing into the steam inlet 311 through the flow path formed to encircle the coupling holes 314*a* and 314*b* may be effectively transferred to the positions where the first steam sprayers 312*a* and 312*b* are disposed.

Also, in the steam nozzle 300, the steam may be effectively introduced to the second steam sprayers 313*a* and 313*b* through a bypass flow path provided to encircle the tunnel flow paths 3121*a* and 3121*b* and the first steam sprayers 312*a* and 312*b* formed at the first steam sprayers 312*a* and 312*b*.

Therefore, the steam may be more uniformly sprayed from the first steam sprayers 312*a* and 312*b* and the second steam sprayers 313*a* and 313*b* to the washing chamber 12*a*, enhancing reliability of the steam nozzle 300.

Specific embodiments have been described but the present disclosure is not limited to the specific embodiments and various modifications may be made without departing from the scope of the present disclosure claimed in the claims, and such modifications should not be individually understood from technical concepts or prospects of the present disclosure.

While the present disclosure has been particularly shown and described with reference to embodiments thereof, a person skilled in the art will understand that the disclosure is not limited to the disclosed embodiments but may be variously modified within the scope of the present disclosure. Therefore, the scope of the present disclosure should not be limited to the above-described embodiments but should be determined by all changes or modifications derived from the scope of the appended claims and equivalents of the following claims.

What is claimed is:

1. A dishwasher comprising:

a case that defines an appearance of the dishwasher;

a tub that is disposed inside the case and that defines a washing chamber configured to accommodate one or more objects to be cleaned;

a sump disposed vertically below the tub and configured to receive washing water;

a washing pump configured to receive washing water from the sump;

a heater coupled to a lower side of the washing pump and configured to generate steam from washing water received in the washing pump; and a steam nozzle connected to the washing pump by a steam hose and configured to spray steam to the washing chamber, wherein the steam nozzle comprises:

a steam nozzle body that defines a steam inlet configured to receive steam from the steam hose and a steam accommodating portion configured to accommodate steam, a first steam spray orifice having an end in communication with the washing chamber, a first steam sprayer disposed in the steam nozzle body and configured to spray steam accommodated in the steam accommodating portion to the washing chamber through the first steam spray orifice, and a second steam sprayer disposed in the steam nozzle body at a position farther from the steam inlet than the first steam sprayer, wherein the first steam sprayer defines a tunnel flow path that penetrates a lower end of the first steam sprayer and that is configured to allow steam to pass through the lower end of the first steam sprayer and be introduced into the second steam sprayer, wherein the steam nozzle body defines:

a first flow path that extends from the steam inlet toward an inlet of the tunnel flow path, and a second flow path that extends from an outlet of the tunnel flow path toward the second steam sprayer, and wherein the first steam sprayer is configured to spray a portion of steam introduced to the inlet of the tunnel flow path to the washing chamber through the first steam spray orifice and to guide another portion of the steam introduced to the inlet of the tunnel flow path to the second steam sprayer through the second flow path.

2. The dishwasher of claim 1, wherein the first steam spray orifice has a first end that is in communication with the tunnel flow path and a second end that is the end in communication with the washing chamber.

3. The dishwasher of claim 1, wherein a sectional area of the tunnel flow path is greater than a sectional area of the first steam spray orifice.

4. The dishwasher of claim 1, wherein the tunnel flow path has a first end portion facing the steam inlet and a second end portion facing the second steam sprayer, and wherein a sectional area of the first end portion of the tunnel flow path is greater than a sectional area of the second end portion of the tunnel flow path.

5. The dishwasher of claim 1, wherein the steam nozzle body defines a flow path that surrounds at least a portion of the first steam sprayer.

6. The dishwasher of claim 1, wherein the steam inlet is defined at a center portion of the steam nozzle body, and wherein the steam nozzle body extends horizontally from the center portion.

7. The dishwasher of claim 6, wherein the first steam sprayer comprises a pair of first steam sprayers disposed on a first side of the steam inlet and a second side of the steam inlet, the center portion of the steam nozzle body being disposed between the first side and the second side of the steam inlet, and wherein the second steam sprayer comprises a pair of second steam sprayers that are disposed on the first side of the steam inlet and the second side of the steam inlet, each of the pair of second steam sprayers being disposed at a position farther from the steam inlet than each of the pair of first steam sprayers.

8. The dishwasher of claim 7, wherein the tunnel flow path extends in a direction that defines a predetermined angle with respect to a virtual line passing centers of the pair of first steam sprayers.

9. The dishwasher of claim 1, wherein the steam nozzle body defines a flow path that extends from the first steam sprayer toward the second steam sprayer, and wherein a width of the flow path decreases from the first steam sprayer toward the second steam sprayer.

10. The dishwasher of claim 1, wherein the steam nozzle body defines:

a pair of coupling holes disposed at left and right sides of the steam inlet, respectively; and a flow path that surrounds each of the pair of coupling holes.

11. The dishwasher of claim 10, wherein the steam nozzle body comprises at least one guide rib that is disposed between the steam inlet and at least one of the pair of coupling holes and that is configured to guide steam from the steam inlet to the first steam sprayer.

12. The dishwasher of claim 1, wherein the steam nozzle further comprises:

an upper case that is coupled with the steam nozzle body and that defines the steam accommodating portion with the steam nozzle body, the upper case defining a first upper case hole that receives the first steam sprayer and a second upper case hole that receives the second steam sprayer; and a lower case that seats the steam nozzle body and that is coupled to the upper case to define an internal space configured to accommodate the steam nozzle body.

13. The dishwasher of claim 1, wherein the steam nozzle body further defines at least one drain hole disposed at a surface of the steam nozzle body and configured to drain water from the steam accommodating portion.

14. The dishwasher of claim 1, wherein the tub defines a front opening disposed at a front surface of the tub and configured to receive the one or more objects, wherein the steam nozzle is disposed at a lower portion of the front opening and is configured to spray steam in an upward and rearward direction, and wherein the steam nozzle body extends in a lateral direction across the lower portion of the front opening.

15. The dishwasher of claim 1, wherein the steam nozzle body defines:

a pair of coupling recesses that are recessed from a surface of the steam nozzle body toward the steam accommodating portion and that are disposed at left and right sides of the steam inlet, respectively; and a flow path that surrounds each of the pair of coupling recesses.

16. The dishwasher of claim 1, wherein the tunnel flow path connects the first flow path to the second flow path through the lower end of the first steam sprayer.

17. The dishwasher of claim 1, wherein a width of the first flow path increases from the steam inlet toward the first steam sprayer, and wherein a width of the second flow path decreases from the first steam sprayer toward the second steam sprayer.

18. The dishwasher of claim 1, wherein the first steam sprayer comprises a first extension portion that protrudes upward from a bottom surface of the steam nozzle body, wherein the tunnel flow path penetrates the first extension portion, wherein the second steam sprayer comprises a second extension portion that protrudes upward from the bottom surface of the steam nozzle body, and wherein the second steam sprayer defines an inlet that is in communication with the second flow path and that is configured to receive steam through the second flow path.

19. The dishwasher of claim 1, wherein the steam nozzle body further defines an outer flow path that surrounds an outside of the first steam sprayer and that connects the first flow path to the second flow path, wherein the second steam sprayer is configured to receive steam from at least one of the tunnel flow path or the outer flow path, and wherein a width of the outer flow path is less than the width of the first flow path and the width of the second flow path.

20. The dishwasher of claim 8, wherein the predetermined angle is less than 30 degrees.

* * * * *